US005899846A

United States Patent [19]

Sternberg et al.

[11] Patent Number: 5,899,846

[45] **Date of Patent: * May 4, 1999**

[54] CHAMBER

[75] Inventors: Hal Sternberg; Paul E. Segall; Harold D. Waitz, all of Berkeley; Bruce Cohen, Richmond, all of Calif.

[73] Assignee: BioTime, Inc., Berkeley, Calif.

[ * ] Notice: This patent is subject to a terminal disclaimer.

[21] Appl. No.: 08/237,776

[22] Filed: May 4, 1994

Related U.S. Application Data

[63] Continuation of application No. 07/687,842, Apr. 19, 1991, abandoned.

[51] Int. Cl.[6] ..... A61G 10/00

[52] U.S. Cl. ..... 600/21; 128/202.012; 128/205.026

[58] Field of Search ..... 128/202.012, 202.013, 128/204.018, 205.026; 600/21–22

[56] References Cited

U.S. PATENT DOCUMENTS

| | | | |
|---|---|---|---|
| 3,587,574 | 6/1971 | Mercer | 128/204 |
| 3,877,427 | 4/1975 | Alexeev et al. | 600/21 |
| 4,582,055 | 4/1986 | McDougal et al. | 128/202.12 |
| 4,727,870 | 3/1988 | Krasle | 128/202.12 |
| 4,820,280 | 4/1989 | Berch et al. | 604/248 |

FOREIGN PATENT DOCUMENTS

| | | | |
|---|---|---|---|
| 1650-130-A | 5/1991 | European Pat. Off. | A61G 10/02 |
| 1674836-A1 | 9/1991 | European Pat. Off. | A61G 10/02 |
| 537683 | 1/1977 | U.S.S.R. | 128/205.26 |

*Primary Examiner*—John P. Lacyk

*Attorney, Agent, or Firm*—Karl Bozicevic; Bozicevic & Reed LLP; Bret Field

[57] ABSTRACT

A chamber suitable for placing a subject under a pressure greater than atmospheric pressure with means for perfusing, cooling and respiring the subject. The chamber can be used in conjuction with low temperature surgical procedures.

13 Claims, 2 Drawing Sheets

CHAMBER

This application is a continuation of application Ser. No. 07/687,842, filed Apr. 19, 1991 now abandoned.

FIELD OF THE INVENTION

The present invention relates to the field of pressure chambers into which a subject may be inserted and conveniently monitored and maintained.

BACKGROUND OF THE INVENTION

Pressure chambers are generally known and include decompression chambers, diving chambers and closed chambers for placing a living subject under hyperbaric oxygen tension.

When a pressure chamber is used to treat an individual under hyperbaric oxygen tension it is frequently difficult to perform a continuous surgical procedure on such an individual requiring continuous monitoring and or administration of fluids to the patient or subject in the chamber. Conventionally all equipment needed to perform such procedures must be put into the chamber with the subject and the chamber pressurized. Whenever equipment or fluids required replacement the chamber must be depressurized, the required materials replaced and the chamber repressureized.

Conventional chambers also usually do not include an integral stage on which a subject to be treated in the chamber may be supported.

SUMMARY AND OBJECTS OF THE INVENTION

The present invention provides an chamber suitable for placing a subject under a pressure greater than atmospheric pressure, and preferably under hyperbaric oxygen tension. The chamber is equipped with a removable closure through which tubes carrying fluids and electrical leads for monitoring devices and other electrical devices can be conveniently connected while maintaining the chamber under pressure.

The chamber according to the invention may also include a stage integrated with the closure so that the stage may be positioned in the chamber and the closure simultaneously secured to the chamber in one operation. In one embodiment of the invention the closure may support the stage. In another embodiment of the invention the stage may support the closure in such a manner that both the stage and closure can be rolled into position simultaneously. The stage may also be provided with cooling and heating capability to warm or cool the subject supported thereon.

The closure of the chamber is provided with sealable fittings to quickly connect tubes transporting fluids into the chamber and into the subject positioned within the chamber. The closure of the chamber also is provided with electrical fittings to quickly connect electrical wires for electrical sensing and monitoring devices or for electrical devices that may be required to operate within the sealed chamber.

The invention may be better understood in connection with the following Figures which are intended by the inventors to be merely illustrative of the invention and non-limiting.

DETAILED DESCRIPTION OF THE INVENTION

Figure 1:
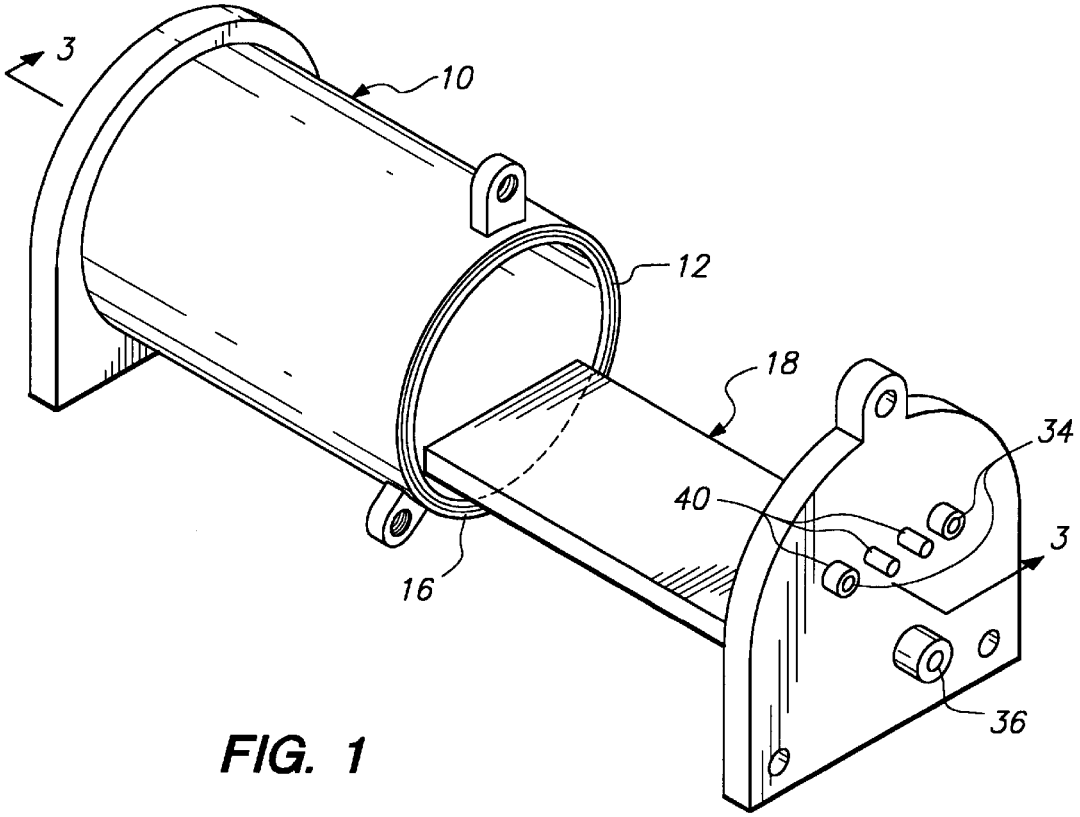
FIG. 1 is a perspective view of a chamber according to the invention in open position.
Figure 2:
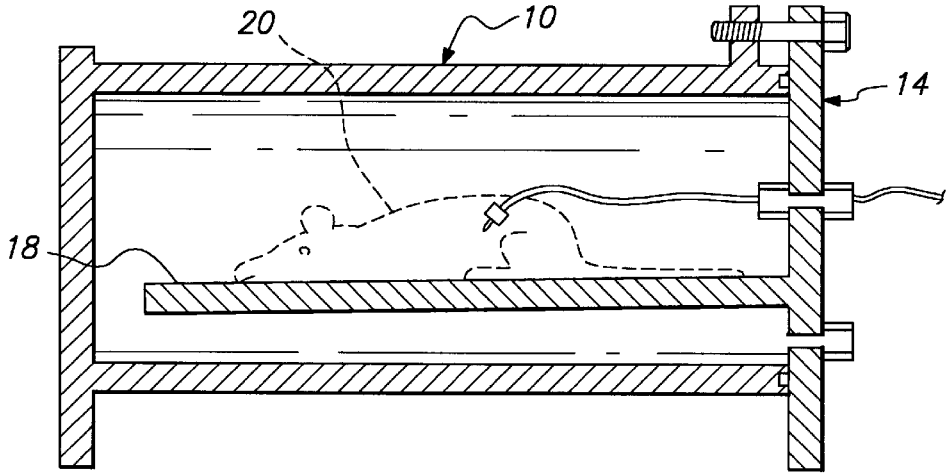
FIG. 2 is a cross sectional view of the chamber of FIG. 1. The subject 20 is shown in phantom lines.
Figure 3:
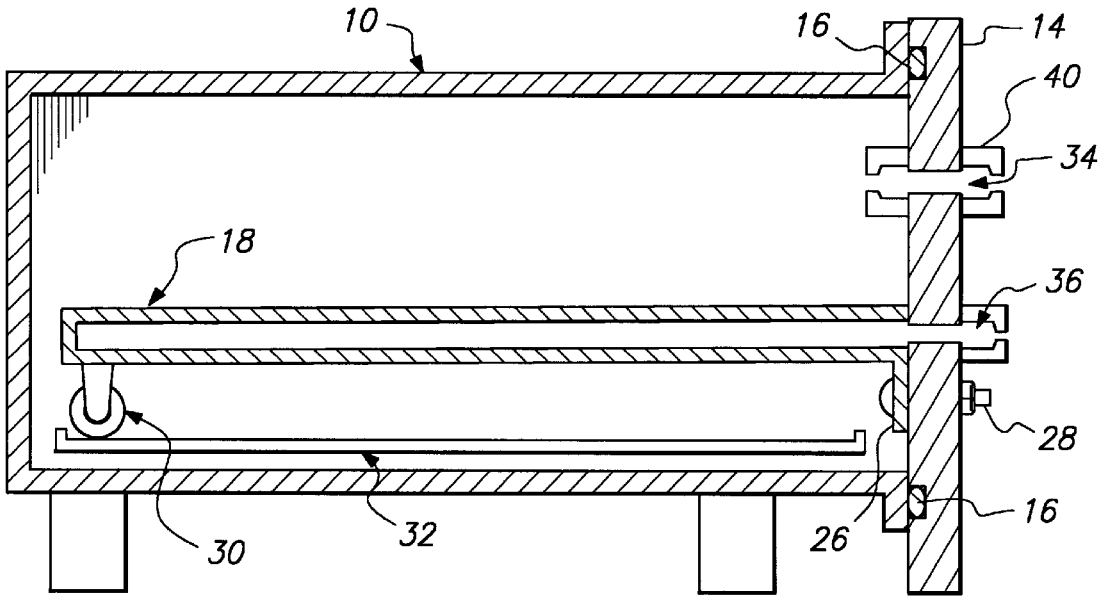
FIG. 3 is a cross-sectional view of an alternate configuration of a chamber in closed position.

In greater detail the present invention is a chamber suitable for placing a subject 20 under a pressure greater than atmospheric pressure, and preferably under hyperbaric oxygen tension. The chamber 10, has at least one opening 12 large enough to accommodate a subject 20 to be placed in the chamber 10. Although, a mouse is pictured in FIG. 2, the chamber 10 and all other parts may be made large enough to accommodate larger subjects. The opening 12 is closed with a closure 14 which when placed over the opening 12 completely seals said opening. A sealing means 16 is interposed between the closure 14 and the edges of the chamber 10 at the opening 12. The sealing means may be a compressible gasket, "O" ring or "V" ring for example. In general any compressible material may be used so long as it may be positioned to achieve an air tight seal between the closure 14 and chamber 10 when the closure 14 is secured to the chamber 10. It is preferable that the chamber 10 have one opening and closure 14 therefor at one end of the chamber 10. If more than one opening 12 and closure 14 are provided each one is provided with sealing 16 means as described herein above.

A stage 18 is attached to the closure 14 so that the stage 18 and the closure 14 may move together as a unit. The stage 18 may be permanently attached to the closure 14 or removably attached to the closure 14. If permanently attached the stage 18 may be attached to the closure 14 by any means suitable to the materials from which the closure 14 and stage 18 are made. Welding, brazing or casting may be use if the closure 14 and stage 18 are metal. Adhesives may be used if the closure 14 and stage 18 are of unlike materials. If both the stage 18 and closure 14 are made of suitable plastic the stage 18 and closure 14 may be melted, molded or glued together to permanently attach the stage 18 to the closure 14.

The stage 18 and closure 14 are attached to one another so that when the closure 14 is secured to the chamber 10 the stage 18 is positioned to support a subject 20 laying on the stage 18 inside the chamber 10. In general the closure 14 and stage 18 are planar materials that are oriented perpendicularly to one another so that when the closure is secured to the chamber 10 the stage 18 forms a horizontal bed on which a subject 20 may be positioned.

Preferably the stage 18 and closure 14 are not permanently attached to one another but may be connected and disconnected from on another, by connecting means. For example the closure 14 may be provided with a ledge having holes therein sized and spaced to receive pegs attached to the end of the stage 18. Alternately, the end of the stage 18 may be provided with tabs or a flange 26 parallel to the plane of the closure 14 surface. The tabs or flange 26 are provided with holes 24 through which bolts 28 may be threaded into threaded holes in the closure 14. Other means for connecting and disconnecting the stage 18 may be used without departing from the spirit of the invention.

For large chambers and stages it is desirable to equip the stage 18 with means for supporting the stage 18 and moving the stage 18 into the chamber 10. Such support means may be permanently attached to the stage 18 or, the stage 18 may be connected and disconnected from said support means.

Such support means are exemplified by legs attached to the underside of the stage.

The legs may be self supporting so that the stage 18 may be connected and disconnected therefrom conveniently. For example the under side of the stage 18 may be provided with pegs. The legs are attached to one another with cross members whereby the legs are self-supporting. The tops of the legs are tubular or are provided with sleeves sized to receive the pegs on the underside of the stage.

The legs may be equipped with rolling means to roll the stage 18 or stage 18 connected to the closure 14 into the chamber 10. Such rolling means are exemplified by wheels 30 and tracks 32 leading into the chamber 10, or casters and linear bearings. The legs may be permanently or removably attached to the rolling means.

The stage 18 may also include means for regulating the temperature of the subject 20 supported on the stage. The stage 18 may be hollow and have at least one inlet 36 and one outlet 38 through which cooling or heating solutions may be circulated via the fluid transport means described further herein below. Alternatively, the stage 18 may be provided with a continuous hollow member or plurality of connected hollow members around the edge of the upper surface through which cooling or heating solutions may be circulated via the fluid transport means described further herein below.

In another embodiment, the stage 18 may have means for containing ice packs or an ice bath. The stage 18 in this embodiment is formed as an open container. In this embodiment, the stage 18 may have sides around the perimeter thereof forming a shallow trough into which ice packs, ice or a slurry of ice and water may be loaded to provide surface cooling of the subject 20 supported on the stage.

The closure 14 is provided with at least one feed-through 34 therein. By feed-through 34 is meant a passage or aperture in the closure 14 through which means for transporting fluids or electrical wires may be routed while maintaining the closed sealed chamber 10 under pressure. The feed-through 34 is sealed around the fluid transport means or electrical wires. Preferably a plurality of feed-throughs 34 for electrical wires and fluid transport means are provided in the closure 14.

Generally the fluid transport means are tubes or pipes suitable for transporting physiological liquids, which may or may not be sterile, or gasses therein. Such fluid transport means may include means for perfusing a subject 20 with a liquid, means for carrying respiratory gasses to and from a subject 20 in the chamber 10, means for regulating the temperature of the subject 20 in the chamber 10 by circulating warm or cold liquids in a loop in the chamber 10 in contact with the subject 20, means for sampling a subjects physiological fluids such as urine or blood by connecting a catheter or cannula to the subject 20 in the chamber 10 and withdrawing such fluid for analysis through a tube connected to the catheter of cannula.

It is preferable to use quick connect devices for connecting such fluid transport means together through the feed-through 34 in said closure 14. A variety of quick connect devices for tubing are available from commercial vendors and may be used with the chamber 10 according to the invention.

The fluid transport means as described above may be include elements made of flexible tubing. As the chamber 10 according to the invention is designed to contain pressures exceeding atmospheric up to about 5 atmospheres, such tubing will be selected to have walls sufficiently rigid to resist collapsing when used within the pressurized chamber 10. Ribbed or wire reinforced tubing may be used.

With respect to the use of the chamber 10 as a hyperbaric chamber or hyperbaric oxygen chamber the means for carrying respiratory gasses to and from a subject 20 in the chamber 10 will include means for ventilating the subject 20 under pressure. The invention in one embodiment includes means for substantially instantaneously sensing the pressure in the chamber 10 and means for adjusting the pressure of the ventilating means through out the ventilating cycle. The means for sensing the pressure in the chamber 10 and adjusting the pressure of the ventilating means my be a differential pressure gage, having a sensor reporting the pressure in the closed chamber 10 and a sensor reporting the pressure in the tube leading from the ventilator to the respiratory track of subject 20 in the chamber 10. The pressure in the ventilator line will be increased or decrease within a predetermined range over a predetermined time in response to the signal generated by the differential pressure gage.

When used in connection with the closed pressurized chamber 10 according to the invention, the ventilator will ventilate a subject 20 in the chamber 10 at pressures between 1 and 5 atmospheres, and preferably at pressures in a range between 1 and 3 atmospheres. The maximum respiratory pressure of the ventilator as determined by the difference between the pressure in the chamber 10 and the pressure in the ventilator line leading from the ventilator to the subject 20 in the chamber 10 is adjustable in a range between 1 to 35 cm $H_2O$, preferably in a range between 1 to 5 cm $H_2O$.

The means for regulating the temperature of the subject 20 in the chamber 10 by circulating warm or cold liquids in a loop in the chamber 10 in contact with the subject 20 may be provided in a number or ways. The loop may be integral with the stage 18 as described above. Alternatively the loop in the chamber 10 may be provided by a mat or blanket having at least one passage therein connected via at least one inlet and outlet in the mat though the fluid transport means in the closure 14 to a temperature regulated recirculating fluid bath or reservoir. The mat or blanket is placed on the stage 18 in contact with the subject 20 or on the subject 20 and warm or cold liquids are circulated through the mat.

The closure 14 as mentioned above included feed-throughs 34 therein including means for connecting electrical wires. These wires are connected to electrical devices outside the chamber 10 and the subject 20 inside the chamber 10. Any electrical device my be connected to the subject 20 in side the chamber 10 in this manner. A variety of electrical physiological monitoring devices may be connected to the subject 20 through the closure 14, either singly or in groups. Such electrical physiological monitoring devices include electroencephalographs, electrocardiographs, temperature probes, blood pressure sensor and blood gas sensors. Other devices may be connected through the closure 14 to the subject 20 using the feed-through 34 as described herein. It is preferred that electrical quick connect means such as shielded plug blocks are used to connect the device within the chamber 10 so as to avoid electrical sparks inside the chamber 10, particularly under hyperbaric oxygen conditions.

We claim:

1. A chamber, comprising:

a closure for said chamber;

a stage attached to said closure, wherein said stage comprises means for directly regulating the body temperature of a subject supported on said stage;

at least one feed through in said closure, wherein said feed through comprises fluid transport means comprising heat exchange means and respiratory means;

perfusion means for perfusing said subject with a liquid;

fluid sampling means; and ventilation means, wherein said ventilation means is capable of ventilation at pressures between 1 and 5 atmospheres.

2. The chamber of claim 1 wherein said feed through said closure comprises means for connecting at least one electrical physiological monitoring device.

3. The chamber of claim 1 wherein the closure is moveable relative to said chamber.

4. The chamber of claim 1 wherein said chamber further comprises means for ventilating a subject in said chamber, wherein said means for ventilating comprises means for substantially instantaneously sensing the pressure in said chamber and adjusting the pressure of said ventilating means throughout the ventilating cycle responsive to the pressure in said chamber.

5. The chamber of claim 4 wherein said means for ventilating a subject in said chamber operates at chamber pressures between 1 and 5 atmospheres.

6. The chamber of claim 4 wherein maximum respiratory pressure of the ventilating cycle can be adjusted from 1 to 35 cm $H_2O$.

7. The chamber of claim 4 wherein maximum respiratory pressure of the ventilating cycle can be adjusted from 1 to 5 cm $H_2O$.

8. The chamber of claim 4 wherein said means for sensing the pressure in said chamber and adjusting the pressure of said ventilating means comprises a differential pressure gage sensing the difference between the atmospheric pressure in said chamber and the pressure of the ventilator line to a subject in said chamber and means for adjusting the output pressure of said ventilator in response to a signal generated by said differential pressure gage.

9. The chamber of claim 1 comprising means for connecting and disconnecting said stage to and from said closure.

10. The chamber of claim 1 wherein said stage further comprises means for rolling said stage into said chamber.

11. The chamber of claim 1 wherein said stage further comprises means for attaching said stage to means for rolling said stage into said chamber.

12. The chamber of claim 9 wherein said stage further comprises means for rolling said stage into said chamber.

13. The chamber of claim 9 wherein said stage further comprises means for attaching said stage to means for rolling said stage into said chamber.

* * * * *